US005178244A

United States Patent [19]

Liang

[11] Patent Number: 5,178,244

[45] Date of Patent: Jan. 12, 1993

[54] LUGGAGE WITH UNITARILY PIVOTING FRONT WHEEL ASSEMBLY

[76] Inventor: Joseph Liang, P.O. Box 1060, Alpine, N.J. 07620

[21] Appl. No.: 725,339

[22] Filed: Jul. 3, 1991

[51] Int. Cl.[5] ..... A45C 3/00

[52] U.S. Cl. ..... 190/18 A; 280/47.26; 280/47.34

[58] Field of Search ..... 190/18 R, 18 A; 280/47.26, 47.34, 79.2

[56] References Cited

U.S. PATENT DOCUMENTS

| | | | |
|---|---|---|---|
| 1,822,893 | 9/1931 | Kapolkin | 190/18 A |
| 4,743,038 | 5/1988 | Myers et al. | 280/47.26 |
| 4,756,394 | 7/1988 | Cohen | 190/18 A |
| 4,930,831 | 6/1990 | Valiga et al. | 280/47.34 |
| 5,028,062 | 7/1991 | Pinnell et al. | 280/47.34 |

FOREIGN PATENT DOCUMENTS

| | | | |
|---|---|---|---|
| 3631998 | 3/1988 | Fed. Rep. of Germany | 280/47.34 |
| 1101494 | 10/1955 | France | 280/47.34 |
| 568086 | 3/1945 | United Kingdom | 280/47.34 |

*Primary Examiner*—Gary E. Elkins

*Attorney, Agent, or Firm*—Cohen, Pontani, Lieberman, Pavane

[57] ABSTRACT

A moveable article of luggage includes a closeable article-receiving interior compartment, a bottom wall, at least one free-spinning rear wheel attached to the bottom wall, the front wheels at a fixed distance apart, and a pull-type handle device. The retaining and pivoting assembly provides for unitary and concurrent pivoting of the front wheels about a forward pivoting axis and is pivotally secured to the bottom wall of the luggage article at the forward pivoting axis. The handle device is attached to the retaining and pivoting assembly for distributing and translating the forces required for moving the luggage along an underlying support surface and for changing the direction of rolling travel of the luggage by arcuately pivoting the retaining and pivoting assembly in a direct and unitary manner. In one embodiment, the retaining and pivoting assembly includes a tubular sleeve through which a common axle, on which the two front wheels are carried, is journalled. In another embodiment, the retaining and pivoting assembly includes a common member or plate to which separate front wheels are mounted.

7 Claims, 5 Drawing Sheets

LUGGAGE WITH UNITARILY PIVOTING FRONT WHEEL ASSEMBLY

FIELD OF THE INVENTION

The present invention relates to luggage having wheels for ease of motion on and along an underlying ground or supporting surface, and more particularly to a suitcase or like article of luggage having a pair of front wheels which are unitarily pivotable about an axis substantially centered between the wheels and with respect to the bottom surface of the luggage to enable ease of mobility and directionality of and improved distribution of forces exerted upon the luggage during pivoting, moving and changing of its direction of travel, and to provide enhanced ability to move the luggage in multiple directions along the supporting surface.

BACKGROUND OF THE INVENTION

The typical time pressures encountered by a traveler meeting airplane or train schedules are often complicated by large, cumbersome and/or heavy suitcases or articles of luggage. In order to avoid the direct carrying of such luggage, individual articles of luggage are characteristically rendered movable along an underlying ground surface by the provision of a number of wheel or castors attached to the bottom surface of the luggage such that the wheels may freely spin in a direction of travel and, in some cases, pivot about an axis defined substantially perpendicular to the bottom surface. Each piece of movable luggage also classically possesses a strap or other handle positioned on the top surface or along a side or front face thereof for pulling the luggage along the ground surface and for carrying the luggage from place to place.

The pulling forces for causing such wheeled luggage to move from a resting position to a moving state along the ground surface, or for changing the direction of motion while the luggage is in the moving state, are generally directed to a point located at or above, and most typically substantially higher than, the center of gravity of the luggage. As a consequence, the pulling forces required to move such luggage can easily result in tipping or misdirection along the ground surface. Turning or redirecting of the luggage from a stopped position or while it is in motion requires overcoming the then-current inertial forces by pulling, pushing or twisting the handle or strap in order to translate and distribute turning forces through the luggage to the pivotal axes of the wheels or castors. In this manner, the wheels are turned via such translated forces to change the direction of travel. It can therefore be appreciated that greater force is required to turn such an article of wheeled luggage than to move the article in a straight direction, since a component of the forces exerted must first turn the entire mass of the article to turn the wheels attached thereto, leaving the remaining component for moving the article in its new direction. Moreover, the handle or strap attached to the luggage, through which these forces are applied and distributed, is stressed, and a potential point of failure is established at the point of attachment of the handle. Additionally, changing the direction of motion of the luggage is frequently rendered slow, difficult and imprecise as a consequence of the need to pull, push or twist the handle in order to translate these forces from a twisting action of the mass or weight of the luggage to a pivoting action of the wheels or castors about their pivotal axes. As a consequence, such devices are intrinsically restricted in their freedom of motion as a result of their design and are substantially ineffective and inefficient in their energy-input requirements and in their capacity to suitably distribute the forces for motion.

Castors for container supports, in contrast to those provided for moving luggage along a flat surface, have been known in the art. For example, in U.S. Pat. No. 1,975,291 to Ritter, Jr., a series of castors provide for rotary support of a trunk having opposingly disposed luggage compartments to enable manipulation of the closure of the trunk without requiring a shift or change in position by the operator. However, Ritter, Jr.'s castors are not utilized for moving the luggage along a flat surface.

As shown in U.S. Pat. No. 2,605,989 to Luft, roller assemblies have been used as a turntable base for moving luggage along a flat surface or floor and for providing pivoting of the piece of luggage upon the assembly to which it is attached. However, for the same reasons set forth above, Luft's rolling assemblies are restricted in their freedom of motion and are inadequate in their distribution of the forces required for moving the luggage and changing its direction of motion.

The use of castor mountings for luggage is also known in the art. For example, in U.S. Pat. No. 3,526,921 to Aupke, castors are provided along a bottom face of a suitcase and are removably mounted through socket apertures drilled or punched in the bottom face. Aupke's castors possess the drawbacks described above, i.e., pivoting is imprecise and difficult, and the forces for moving the suitcase are presented at a location that lies a substantial distance above the center of gravity, rather than directly to a pivoting point. Consequently, freedom of motion of Aupke's luggage is restricted, and the forces must be distributed through the handle which, in Aupke's device, is the same handle used for carrying the luggage.

A luggage handle doubling for both carrying and moving a piece of wheeled luggage is also disclosed in U.S. Pat. No. 4,838,396 to Krenzel. Krenzel's luggage handle enables the user to maintain a relatively upright position while dragging the case along a ground surface. The rear face of the luggage equipped in accordance with Krenzel's device possesses a single front castor wheel and non-pivoting rear wheels, i.e., wheels which do not pivot about an axis substantially perpendicular to the rear face of the luggage. Such wheeled luggage possesses the same drawbacks described above and, in addition, the single front wheel provides seriously diminished stability in maintaining the luggage in an upright condition as it is moved along an underlying support surface.

A removable luggage carrier is also described in U.S. Pat. No. 3,861,703 to Gould in which each of four separate castor wheels is mounted on a plate that is attached by Velcro fasteners to a side or rear face of and proximate a respective corner of an article of luggage. The luggage handle normally used for carrying the article equipped with the Gould device is also employed for moving the luggage along a flat surface upon the detachable castor assemblies. Thus, Gould neither addresses nor overcomes the problems discussed above.

OBJECTS OF THE INVENTION

Accordingly, it is an object of the present invention to provide an article of luggage having a wheeled assembly that allows substantially greater multidirectional mobility and pivoting motion of the luggage on and along an underlying support surface.

It is a further object of the present invention to provide a moveable article of luggage wherein the forces for pivoting the article are directed more precisely to the pivoting points of the wheels, at or below the center of gravity.

It is another object of the present invention to provide a wheeled article of luggage having a handle for directly distributing the forces required to commence motion and to change the direction of motion along a support surface to a front wheel assembly that is pivotally mounted to the bottom surface of the luggage.

It is a still further object of the instant invention to provide a wheeled article of luggage having a pair of front wheels attached to a common assembly plate that is pivotally mounted to the bottom surface of the luggage.

It is yet another object of the instant invention to provide a wheeled article of luggage having a handle for supporting and carrying the luggage up an inclined plane or stairway and for manipulating a wheeled assembly pivotally mounted to the bottom surface of the luggage.

SUMMARY OF THE INVENTION

The foregoing and other objects and advantageous features of the instant invention are achieved by the provision of a moveable article of luggage having a closeable article-receiving compartment or cavity bounded by a plurality of walls including a bottom wall or surface, at least one free-spinning rear wheel attached to and depending from the bottom surface, a pair of freely rotating front wheels mounted to a retaining and pivoting assembly that retains the front wheels at a fixed distance apart and which provides for unitary and concurrent pivoting of the front wheels about a forward pivoting axis, the retaining and pivoting assembly being pivotally attached to and depending from the bottom wall of the luggage article at the forward pivoting axis, and a user-graspable pull-handle attached to the retaining and pivoting assembly for distributing and translating the user-applied forces required for moving the luggage along a surface and for changing the direction of motion of the luggage by directly pivoting the retaining and pivoting means in an arcuate direction. In one embodiment, the retaining and pivoting assembly includes a tubular sleeve through which a common axle is journalled, the axle carrying both of the two front wheels at respectively opposite ends thereof. In another embodiment, the retaining and pivoting assembly includes a common member or plate to which the front wheels are dependingly attached and from which the front wheels downwardly extend for engagement with the underlying support surface.

It is thus a feature of the present invention to provide a wheeled article of luggage for which the direction of motion on and along an underlying surface is simply and easily modified by applying forces, through a user-graspable handle, at or below the center of gravity and without having to manipulate or reorient the entire article of luggage.

BRIEF DESCRIPTION OF THE DRAWINGS

Other objects and many of the attendant advantages and features of the present invention will be readily appreciated and better understood by reference to, and through consideration of, the following detailed description of the currently preferred embodiments of the invention in conjunction with the accompanying drawings, in which like reference numerals designate similar parts throughout the several views thereof, and wherein.

DETAILED DESCRIPTION OF THE PREFERRED EMBODIMENTS

Prior art wheeled luggage all possess, almost with uniformity, restrictions in the freedom with which they are movable on and along an underlying ground or support surface upon which they are placed for rolling motion, typically as a result of problems in pivoting and in poor or inadequate force distribution for moving the luggage or for changing its direction of movement along the surface. Such prior art wheel assemblies generally fall within two categories, as represented by the bottom-plan perspectives of FIGS. 1A and 1B.

Figure 1A:
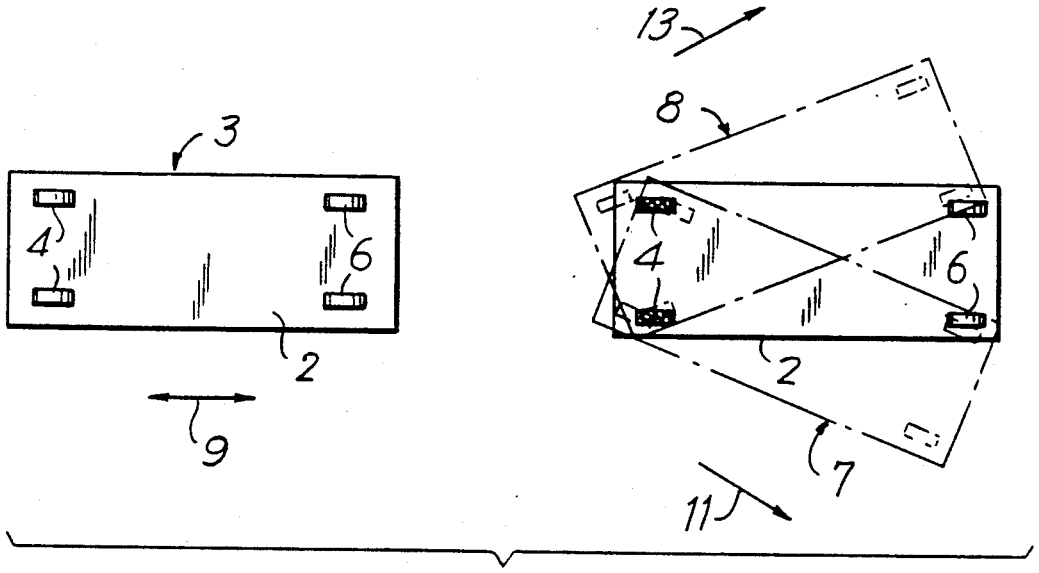
FIG. 1A PRIOR ART
FIGS. 1A and 1B are bottom-plan views of two general types of prior art wheeled luggage assemblies having inherent restrictions in freedom of movement occasioned by the location of the pivot points of the wheels.

In FIG. 1A, a bottom face 2 of a prior art suitcase or article of luggage is shown with a pair of fixed rear wheels 4 and a pair of front swivel wheels or castors 6. In a first depiction 3 of this prior art device, the front wheels 6 are shown parallel to the rear wheels 4 to enable movement in an exact forward or backward direction as indicated by the double-headed arrow 9. In order to pivot or movingly redirect the article of luggage, the article is pulled by a strap or handle (not shown) to swing it to a first perspective position 7 for movement in a first modified direction of travel delineated by the arrow 11, or to a second perspective position 8 for movement in a second modified direction of travel indicated by the arrow 13. The alternative perspective positions 7, 8 are shown in dotted-line format.

As can be observed in FIG. 1A, the entire article of luggage must be moved or reoriented in order to achieve the varied perspective positions 7, 8 for motion in accordance with the arrows 11, 13, which reorientation presents a significant drawback when the article is massive and/or heavy. In other words, the user of the prior art device shown in FIG. 1A must pull or twist the handle to move the entire mass or weight of the luggage into a new direction of travel such as those indicated by the alternate perspective 7 and 8. Typically, this handle is positioned on the top wall or surface of the luggage far from the bottom face 2, and thus well above the article's center of gravity. If the user pulls or pushes too hard, the luggage may tip over instead of turning. If insufficient forces are applied, on the other hand, the luggage will not move at all or will not be completely or properly reoriented in the new direction. And, should the luggage already be in motion, existing inertial forces will tend to defy the user's twisting, pulling or pushing of the entire mass to interfere with the intended achievement of a new direction of rolling movement.

Figure 1B:
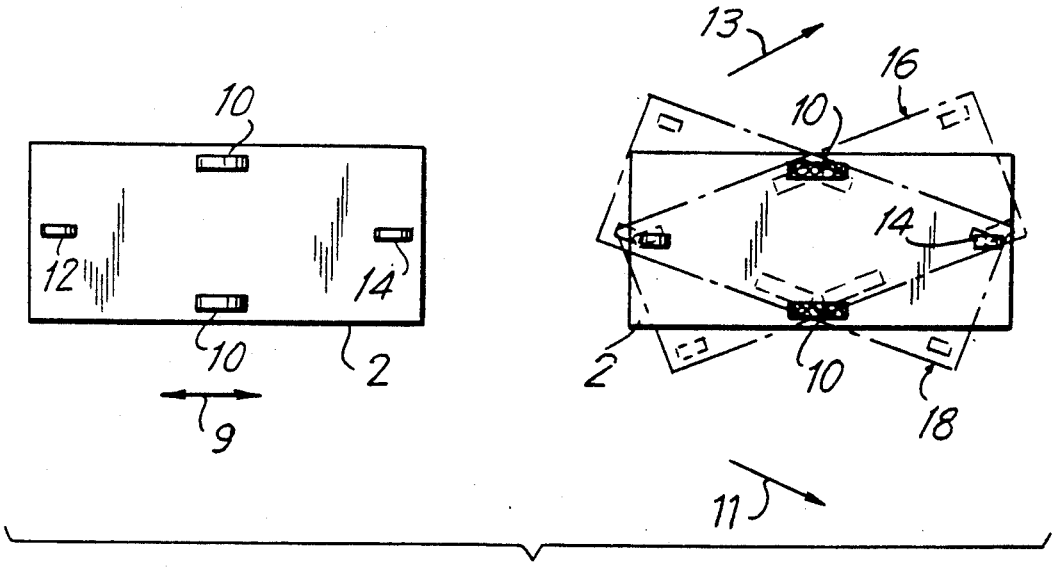
FIG. 1B PRIOR ART

In FIG. 1B, there is shown an alternative prior art embodiment having two center wheels 10 positioned midway between the outer edges of the bottom face 2 of the luggage, as well as a single rear wheel 12 and a single front wheel 14. As can be observed in FIG. 1B, pivoting occurs about the center wheels 10 to change from a standard direction of travel indicated by the double-headed arrow 9 to a first pivoted position 16 having a modified direction of travel denoted by the arrow 13, or to an alternate second pivoted position 18 having a modified direction of travel designated by the arrow 18. As in the FIG. 1A embodiment, however, the entire piece of luggage of FIG. 1B must be moved or reoriented in order to pivot the wheels and attain a new direction of travel. Thus, the FIG. 1B embodiment possesses the same restrictions and drawbacks as those found in the FIG. 1A embodiment of prior art wheeled luggage.

Figure 2:
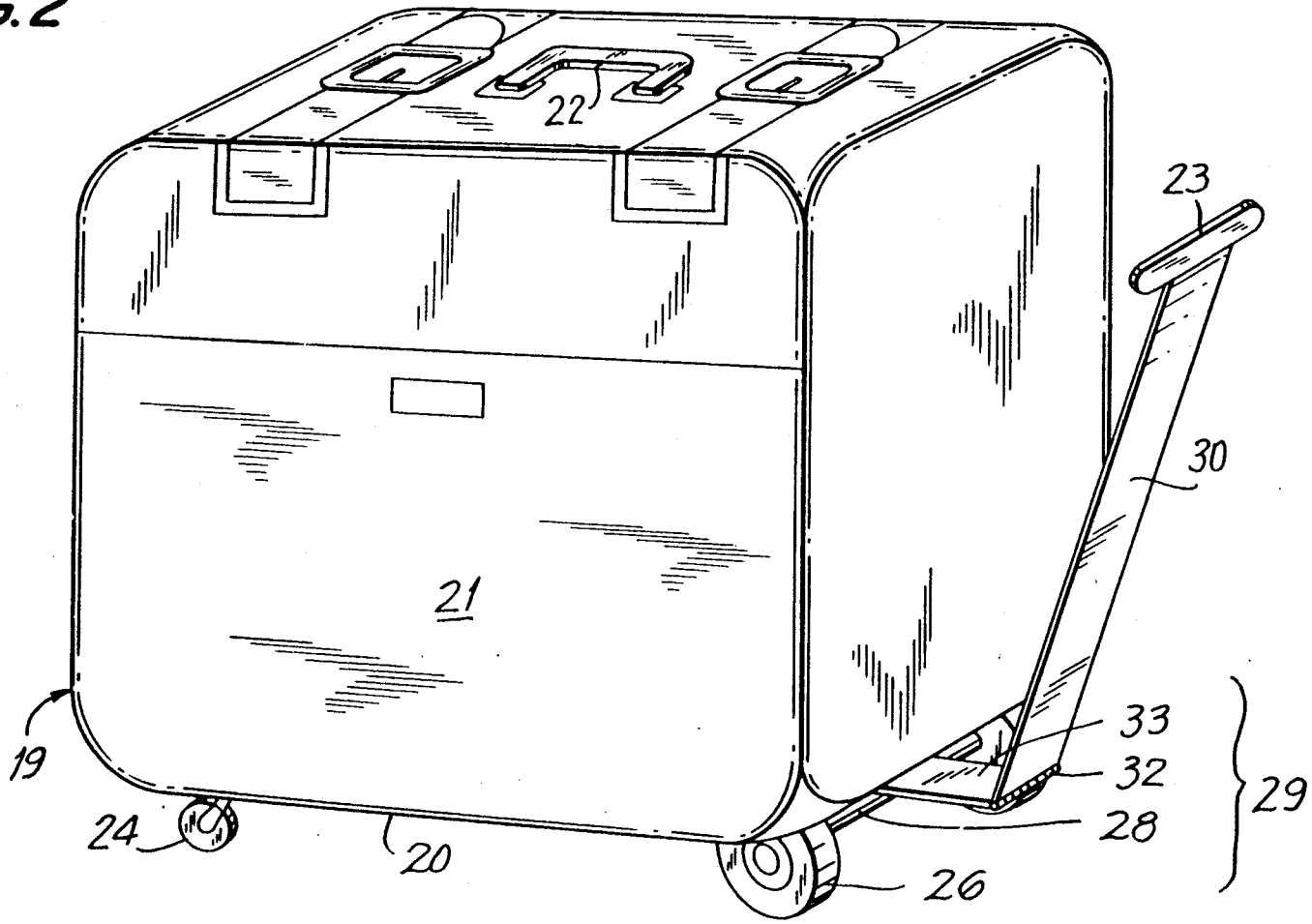
FIG. 2 is an elevated side perspective view of an article of luggage having a pivoting front wheel assembly constructed in accordance with a preferred embodiment of the instant invention.

Accordingly, a new suitcase or article of wheeled luggage 19 constructed in accordance with the present invention is shown in FIG. 2. The luggage 19, as is known in the art, is conventionally formed of a multiplicity of sides and walls that boundingly define a closeable interior compartment or cavity or space and may include a standard hinged U-shaped handle 22 for direct lifting and carrying of the luggage but which is not generally intended to serve or function for readily moving or changing the direction of rolling motion of the luggage on and along an underlying support surface. The luggage 19 also possesses a unique front wheel assembly and pivoting system 29 that is pivotally attached to a bottom wall or surface 20 of the luggage 19, as is further shown in FIG. 3. The rear end of the luggage 19 carries at least one wheel 24—and preferably two—which freely spins during travel but which is preferably fixed in orientation so as to be nonpivotal relative to the bottom wall 20. Put another way, the rear wheel 24 preferably spins or rotates, during rolling movement of the luggage 19 on and along an underlying support surface, within a plane that lies and remains substantially parallel to a sidewall 21 of the luggage 19. Although a modified embodiment in which one or more rear wheels 24 are each arranged for independent pivotal rotation about the axis from which each respectively depends from the luggage bottom wall 20—or in which the rear wheels are implemented by castors or the like—is also contemplated, such an alternative is not currently preferred.

A front wheel assembly and pivoting system 29, as seen in FIG. 2, includes a pair of front wheels 26 (the second of which is not visible in FIG. 2) spaced apart or separated by—and carried on—a common axle 28 that is attached to a mounting plate 33 which is further depicted in FIG. 3 and described hereinbelow. The mounting plate 33 is hinged at fulcrum 32 for movement relative to a pull handle shaft 30. A user-graspable handle 23 of any suitable shape or construction may be conveniently mounted on or coupled to the free or topmost end portion of the shaft 30 to facilitate user grasping and manipulation of the luggage as it is pulled on and along an underlying ground or support surface.

Figures 3A, 3B:
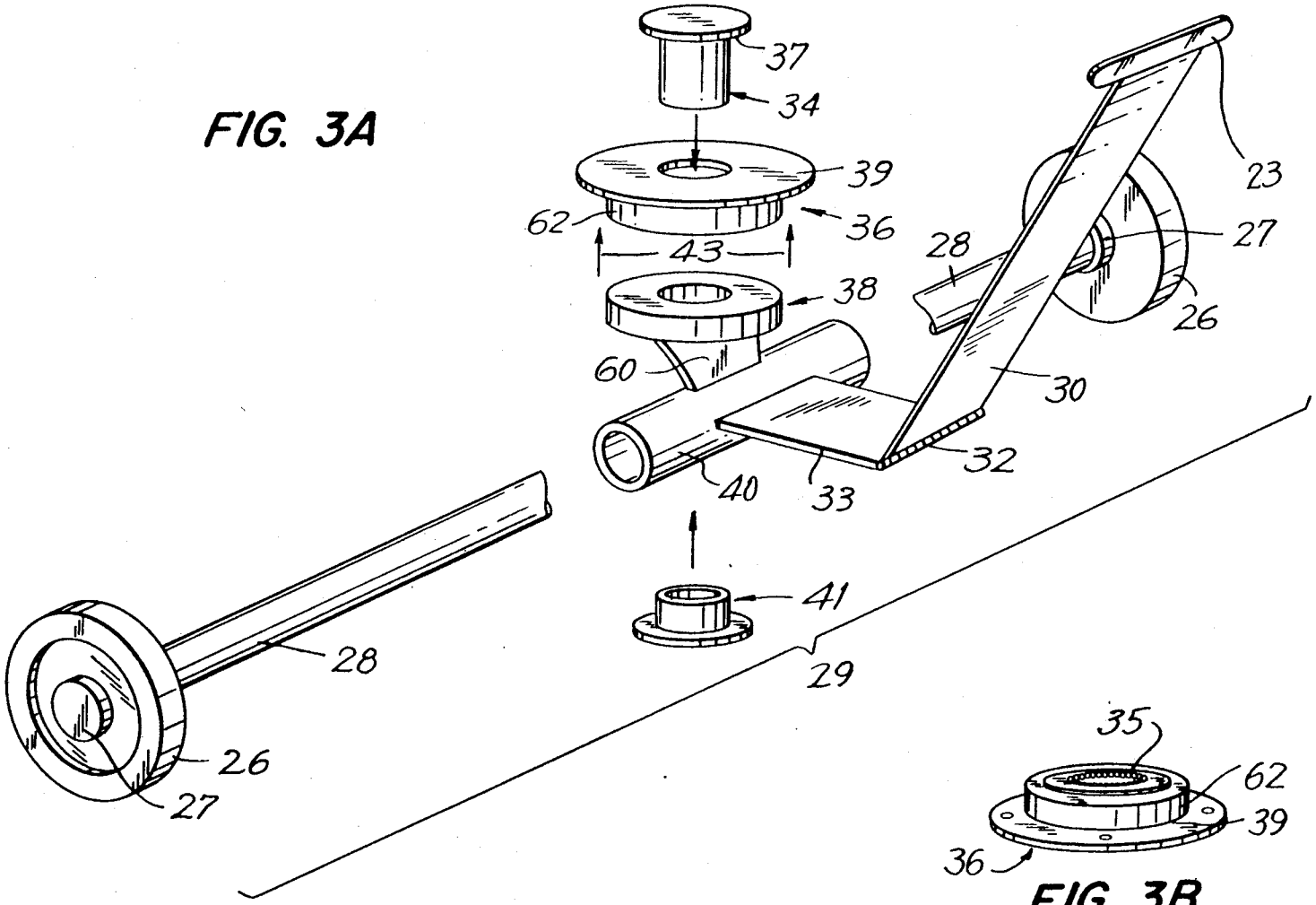
FIG. 3A is an exploded perspective view of a pivoting front wheel assembly of the instant invention in accordance with the embodiment shown in FIG. 2.
FIG. 3B is an elevated perspective detail of the ball bearing housing member of the assembly of FIG. 3A.

FIG. 3A depicts an exploded perspective view of the front wheel assembly and pivoting system 29 of FIG. 2, wherein the front wheels 26 are shown as being fixedly spaced apart and separated by the common axle 28 that attaches to a pair of hubs 27 centeredly coupled to the opposed wheels 26. It will be understood that in this currently preferred and hereindisclosed embodiment of the invention the two front wheels 26 remains, at all times, oriented for rotation within relatively parallel planes that lie substantially normal to the elongation of the axle 28. Most preferably, each of the wheels 26 is arranged for independent rotation relative to the common axle 28 on which it is carried so as to permit each wheel to concurrently rotate at different rotational rates as the luggage 19 is rolled along a supporting surface and, more particularly, as the axle 28 pivotally rotates relative to the bottom wall 20 of the luggage as will hereinafter be described. Thus, each of the hubs 27 may be surrounded by or carry or be associated with a ball bearing assembly or like means to permit such free rotational motion of the respective wheel 26 about the axle 28. The common axle 28 is carried or supported by and is journalled within a hollow, generally tubular sleeve or member 40 through which the axle 28 passes. Since it is most preferred that each of the wheels 26 be independently rotatable relative to the axle 28, the axle may be tightly fitted or journalled against rotation within the sleeve 40. On the other hand, arrangements in which the tubular sleeve 40 is loosely journalled for relative rotation through the sleeve—with or without rotatability of the front wheels relative to the common axle—are also contemplated and, in such an alternate arrangement, the sleeve 40 may optionally incorporate a ball bearing or other rotational assemblage contained therewithin to minimize frictional wear and engagement between the inner wall of the tubular sleeve 40 and the peripheral surface of the axle 28 and thereby further minimize the user-imparted effort required to pull or move the luggage 19 rollingly along an underlying support surface.

The front wheel assembly 29 is permanently secured to and carried dependingly from the bottom surface 20 of the article of luggage 19 for pivotable rotation of the wheel assembly 29 about an axis defined substantially normal to and projecting outwardly from the bottom surface 20. Toward this end, the assembly 29 includes a mounting and pivoting system comprising a flanged plug or pin axle 34, a ball bearing housing 36 (seen in additional detail in FIG. 3B), a mounting collar 38 that is carried on the sleeve 40, as for example atop an arm 60, and a cap rivet 41 for engagement with the pin axle 34. The general arrangement and interengagement of these elements will be apparent from the exploded perspective view of FIG. 3A. The bearing housing 36 includes a neck 62 within which a multiplicity of ball bearings 35 are peripherally seated or carried and a diametrically widened flange 39.

To mount the front wheel assembly 29 to the luggage 19, the bearing housing 36 is inserted, from the interior article-receiving compartment of the luggage, through a suitably sized cutout (not shown) in the bottom wall 20 of the luggage so that its neck 62 projects outwardly through the cutout while its flange 39 remains within the interior luggage chamber in abutting engagement with the inner face of the bottom wall 20. The bearing housing 36 is, in addition, preferably fixed or secured against relative movement and disengagement to the bottom wall 20, as for example by rivets or screws or the like extending through a plurality of bores defined in the housing flange 39 and into or through the wall 20. The ring-like collar 38, to which the wheel axle sleeve 40 is mounted by way of the arm 60, is positioned so as to abut the neck 62 and, more particularly, so that the ball bearings 35 of housing 36 contact the upstanding surface of collar 38 for rolling engagement thereon and therewith. In this manner reduced friction pivotal rotative movability of the collar 38—and, with it, of the common axle 28 on which the front wheels 27 are carried—relative to the fixed bearing housing 36 is facilitated by the ball bearings 35. Mutual securement, for relative pivotal movement therebetween, of the bearing housing 36 and collar 38 is implemented by the plug axle 37 that is inserted, from the interior luggage compartment or cavity, through the centrally-defined openings in the housing 36 and ring-like collar 38, and through engagement of the axle 37 with the cap rivet 41 that is located at the underside of the collar 38. Thus, the plug axle defines the pivot axis about which the front wheels-carrying common axle 28 is pivotally rotatable for redirecting the rolling movement of the luggage 19 along the underlying support surface. Although it is generally contemplated that the pivot axis be located substantially centrally between the spaced apart front wheels 27, as is depicted in the drawings, it should also be noted, and apparent, that embodiments in which the pivot axis is disposed predeterminately off-centerly between the front wheels are also within the intended scope of the invention.

As should now be evident, as the handle shaft 30 is moved—i.e. to one side or the other—by the user to vary the direction of rolling motion of luggage 19 along the support surface, it directly rotates and causes the axle-carrying sleeve 40 to pivot about the axis defined by the pin axle 34. The sleeve directly and correspondingly pivots the journalled axle 28 and, with it, both of the front wheels 27 which thus move as a single unit to immediately change the direction of rolling travel of the luggage along the underlying support surface. The orientation of the luggage 19 as a whole, however, only gradually changes, thereby minimizing the user-applied effort and forces that are required to overcome existing inertial forces or to otherwise accomplish the redirection and eventual reorientation of the luggage. All of this is accomplished without sacrificing or endangering the stability of the luggage, irrespective of the extremity of the redirection or suddenness of the turn.

Figure 4A:
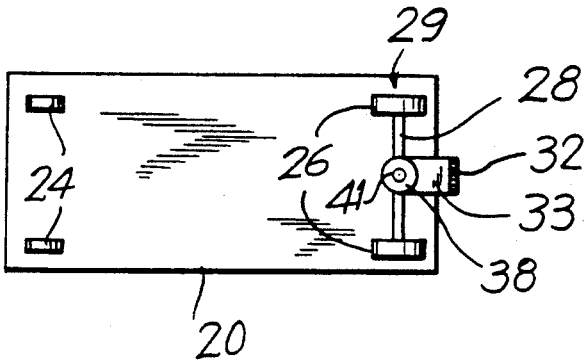
FIGS. 4A and 4B are bottom-plan views of a wheeled article of luggage including a pivoting front wheel assembly of the instant invention in accordance with the embodiment shown in FIGS. 2 and 3.
Figure 4B:
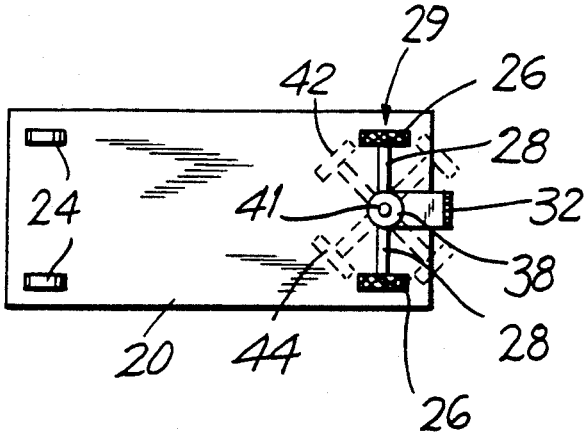

As illustrated in FIGS. 4A and 4B, it can now be observed that the direction of rolling motion of the luggage 19 along an underlying support surface can be selectively determined and varied without the necessity of moving or reorienting the entire mass or weight of the luggage so as to immediately redirect the direction of travel of the suitcase. Indeed, the pull handle assembly, through its direct connection to the axle-carrying sleeve 40, is effectively rotatable about a pivot point or axis defined at the pin axle 34 of the assembly 29 to quickly and easily change the direction of rolling luggage movement. Thus, either or both of the first and second pivoted positions 42, 44 seen in FIG. 4B are achievable, as the handle shaft 30 is pulled in the appropriate direction, by simple pivotal rotation of the entire wheel assembly and system 29, about the pivot axis, relative to the bottom surface or wall 20 of the luggage rather than by having to immediately redirect or reorient the entire weighted article of luggage 19. It will be further recognized that this selective reorientation in the direction of rolling travel of the luggage 19 occurs through a direct translation of the forces exerted on the pull handle shaft 30 to the pivot point of the axle 34, and is applied to the luggage proximate its bottom wheel-bearing surface 20 at a level just slightly above the ground. Thus, the forces utilized to induce a redirection of the rolling luggage and the pivoting of the wheel assembly 29 are applied below, and generally well below, the center of gravity of the luggage 19, thereby minimizing or substantially eliminating the potential for tipping and misdirection which are so prevalent in prior art wheeled suitcase constructions such, for example, as those illustrated in FIGS. 1A and 1B. Similarly, the pulling, pushing and twisting forces and movements that are an unfortunate characteristic of prior art wheeled luggage are not present or required in the use of the luggage of the present invention since the handle-bearing shaft 30 enables simple arcuate pivotal movement of the entire pivotally-mounted front wheel assembly 29 without regard to whether the luggage 19 is already in rolling motion along an underlying support surface or is, at that moment, at rest. Accordingly, redirection or changes in the direction of rolling movement of the wheeled luggage of the present invention can be effected quickly, with minimal user-initiated forces and, significantly, virtually irrespective of then-present inertial forces due to existing forward rolling motion of the luggage.

Figure 5A:
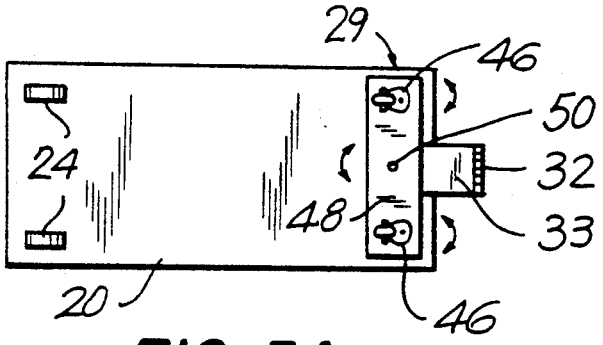
FIGS. 5A and 5B are bottom-plan views of a wheeled article of luggage including a pivoting front wheel assembly in accordance with an alternate embodiment of the instant invention.
Figure 5B:
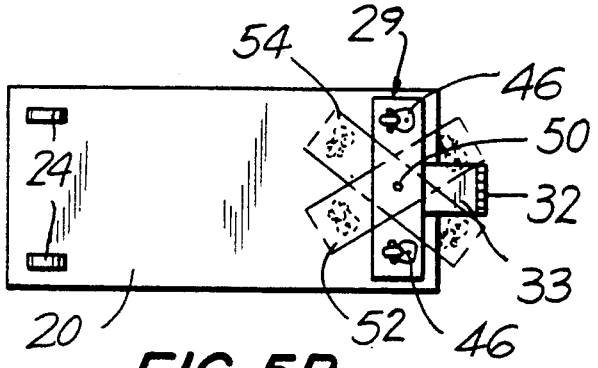

FIGS. 5A and 5B illustrate an alternative embodiment of the instant invention which includes a common member or plate 48 in lieu of the single axle 28 of the previously-described arrangement. The common member or plate 48, which may for example be implemented as an elongated, substantially flat plate or framework, is dependingly attached to the bottom surface or wall 20 of the luggage at a pivot point 50 by an assemblage of elements similar or substantially identical to that shown in FIG. 3A. In this further embodiment, each of the front wheels 46 is implemented as a separate unit that is mounted to the plate 48 proximate a respective one of the ends thereof. Moreover, each wheel 46 is most preferably mounted to the plate 48 in a fixed or nonpivotal manner so that the wheel is rotatable, as the luggage moves along a support surface, in a plane that lies and remains substantially normal to the elongation of the plate 48. Of course, embodiments in which the front wheels 46 independently pivot or rotate relative to, and about axes defined substantially normal to, the plate 48, or in which the wheels are implemented by ball-type castors or the like, are also contemplated although, in order to maximize stability of the luggage, are not presently preferred. Here, too, the pivot axis of the plate 48 relative to the bottom wall 20 of the luggage may be noncenteredly offset between the opposed front wheels 46, and/or may be offset rearwardly or forwardly relative to the locations of the wheels 46. The two wheels 46 may also be located on the plate at different spacings from the edges or bounds of the plate 48, either with respect to the transverse edges or the front/rear edges, or both, of the plate 48.

Figure 6:
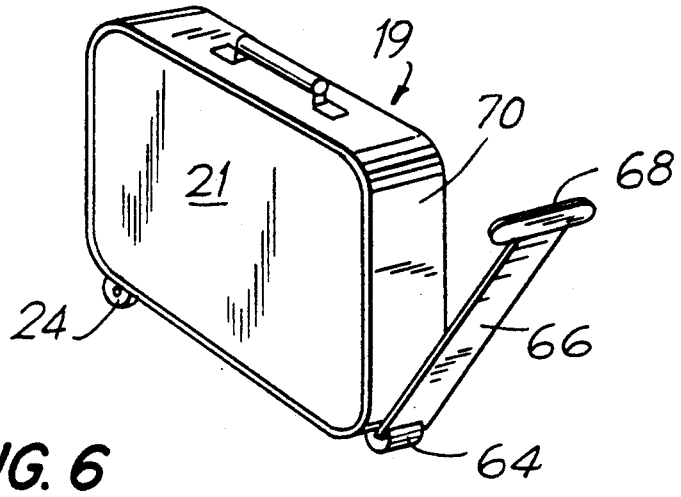
FIGS. 6 is an elevated perspective view of another embodiment of a wheeled article of luggage in accordance with the present invention.

FIG. 6 depicts still another, but somewhat less preferred, embodiment of the invention in which the article of luggage 19 carries on its bottom wall or surface 20 a pair of nonpivotable rear wheels 24 (only one of which is visible) and a single front wheel 64. The front wheel 64 is attached dependingly from the bottom wall 20 substantially centrally between the luggage sidewalls—one of which is identified by the reference numeral 21 in FIG. 6—for pivotal rotation relative to the bottom wall and about an axis defined by its attachment thereto. For this purpose, the front wheel 64 may be attached to the bottom wall 20 by any suitable structural arrangement of elements including, by way of example, one such as that illustrated in FIG. 3A in respect of the first-disclosed embodiment and which is readily adaptable to a single-wheel form. In any event, numerous constructions for attaching a single front wheel to the bottom wall 20 of the luggage 19 for pivotal rotation relative to the wall 20 will be apparent to those of ordinary skill in the art, and the exact form of that attachment will generally be a matter of design choice.

A pull-handle shaft 66 carrying at its free end a user-graspable handle part 68 is attached to the front wheel 64 at its end opposite the handle 68. The shaft 66 may, by way of example and as shown, directly engage the shaft about which the wheel 64 rotates as it moves on and along the underlying ground or support surface, or it may directly engage a housing or like element of the wheel 64 and by which the wheel is pivotally attached to the bottom wall 20 of the luggage. Whatever the exact manner of engagement of the shaft 66 and front wheel 64—and many such forms are possible—it is required only that the shaft and wheel be linked so that, as the user pulls the luggage along the support surface by the handle part 68, any user-imparted angular rotation or pivoting of the handle shaft 66 from the then-current direction of travel of the luggage be directly transferred to the front wheel 64 so as to directly and correspondingly pivot the wheel 64 to the new intended direction of luggage movement. As should be apparent, this direct transfer of user-imparted, luggage-redirecting angular motion from the handle to the front wheel is operatively the same as that which results in using each of the various two-front-wheel embodiments of the invention disclosed hereinabove in conjunction with FIGS. 2 to 5. In all of these embodiments, the pull handle connects to the luggage well below its center of gravity—most particularly through a linkage at or closely proximate the front wheel(s)—so as to directly transfer and impart user-applied turning forces to the front wheel(s) which immediately pivot to redirect the direction of travel without the need to rapidly reorient the luggage to the new travel direction as in the prior art. This advantageously results in a notable reduction in the effort and forces that must be applied by the user and permits tighter turns and increased ease of redirection as the luggage is pulled or moved on and along an underlying support surface. Another advantage to such a construction, as also pointed out hereinabove, is increased stability and deterrence to tipping of the pulled article of luggage.

Since the luggage 19 of FIG. 6 includes only a single front wheel 64, its overall stability in maneuvering through unusually tight or convoluted turns can be further enhanced by providing, as seen in FIG. 6, a wheel of relatively enlarged width. Thus, for example, a wheel width of approximately one-and-one-half inches or more will be found to increase the overall stability of the luggage. Indeed, constructions in which the front wheel 64 extends for a substantial portion, or for even the entirety, of the width of the luggage 19 are within the intended scope and contemplation of the invention. It should also be noted that although the handle shaft 66 is illustrated in FIG. 6 as a single elongated element that extends from the handle part 68 to its engagement with the front wheel axle and may, accordingly, include a suitable bend proximate such engagement with the wheel to facilitate the pivoted movability of the shaft to a storage position of nonuse (not shown) in general abutment with the luggage front wall 70, alternative forms or constructions of the shaft 66 may be employed as a matter of design choice. For example, the shaft 66 may be hinged, as in the embodiment illustrated in FIG. 3A, forwardly of the front wall 70 to an extension member that is itself linked to the front wheel 64 for directly pivoting the wheel with user-imparted rotative redirection of the pull-handle shaft 66. These and other modifications will readily suggest themselves to persons of skill in conjunction with the teachings of the present invention as herein disclosed.

While there have been shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. It is the intention, therefore, to be limited only as indicated by the scope of the claims appended hereto.

What is claimed is:

1. An article of wheeled luggage rollingly movable on and along an underlying support surface in a user-controllable direction of movement, comprising:

a plurality of walls bounding an interior, closable compartment for containing articles within said compartment, said plural walls including a bottom wall;

a freely spinnable rear wheel mounted to and projecting from said bottom wall for rolling engagement with the support surface;

a pair of freely rotatable front wheels for rolling engagement with the support surface;

unitary means for carrying said front wheels in spaced apart relation at a fixed distance apart, said means being pivotally attached to said bottom wall for pivotal movement of said means relative to said bottom wall about a pivot axis defined between said spaced apart front wheels so as to provide concurrent pivotal movement of said front wheels relative to said bottom wall and thereby facilitate changes in the direction of movement of said article of luggage along the support surface as said unitary means is pivotally moved relative to the bottom wall, and said unitary means comprising a plate on which each of said front wheels is carried, said plate being pivotally movable relative to said bottom wall about said pivot axis; and pull-handle means attached to said unitary means and graspable by a user for transferring user-applied, selectively-directed pull forces to the article of luggage for moving the article along the support surface and for selectively changing the direction of movement of the article of luggage along the ground surface by pull-handle means-imparted movement of said unitary means relative to said bottom wall.

2. An article of wheeled luggage in accordance with claim 1, wherein said pull-handle means is connected to said plate for transferring user-applied pull forces to the article of luggage through said unitary means.

3. An article of wheeled luggage in accordance with claim 1, wherein said unitary means further comprises pivot means for providing said pivotal attachment of said unitary means to said bottom wall, said pivot means comprising a first member secured to said bottom wall, a second member secured to said plate, and bearing means for facilitating pivotal movability between said first and second members as said plate is pivotally moved relative to said bottom wall.

4. An article of wheeled luggage rollingly movable on and along an underlying support surface in a user-controllable direction of movement, comprising:

a plurality of walls bounding an interior, closable compartment for containing articles within said compartment, said plural walls including a bottom wall;

a pair of freely spinnable rear wheels mounted to and projecting from said bottom wall for rolling engagement with the support surface;

a freely rotatable front wheel for rolling engagement with the support surface;

unitary means for carrying said front wheel and pivotally attached to said bottom wall for pivotal movement of said means relative to said bottom wall about a pivot axis defined at said attachment and substantially normal to said bottom wall, said unitary means comprising a plate on which said front wheel is carried, said plate being pivotally movable relative to said bottom wall about said pivot axis; and pull-handle means attached to said unitary means and graspable by a user for transferring user-applied, selectively-directed pull forces to the article of luggage for moving the article on and along the support surface and for selectively changing the direction of movement of the article of luggage along the ground surface from a then-current to an arcuately-modified direction of movement by directly transferring user-imparted pivotal movement of said pull-handle means from the then-current to the arcuately-modified direction of movement to said attached unitary means so as to directly impart said user-imparted pivotal movement to said unitary means and thereby directly pivot said front wheel relative to said bottom wall to cause said article of luggage to move in said arcuately-modified direction.

5. An article of wheeled luggage in accordance with claim 4, wherein said pull-handle means is attached to said plate.

6. An article of wheeled luggage in accordance with claim 4, said front wheel being carried in a fixed orientation on said plate.

7. An article of wheeled luggage in accordance with claim 4, wherein said unitary means further comprises pivot means for providing said pivotal attachment of said unitary means to said bottom wall, said pivot means comprising a first member secured to said bottom wall, a second member secured to said plate, and bearing means for facilitating pivotal movability between said first and second members as said plate is pivotally moved relative to said bottom wall.

* * * * *